US008262862B2

(12) United States Patent
Ohuchi

(10) Patent No.: US 8,262,862 B2
(45) Date of Patent: Sep. 11, 2012

(54) FELT FOR PAPERMAKING

(75) Inventor: Takashi Ohuchi, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 196 days.

(21) Appl. No.: 12/743,668

(22) PCT Filed: Nov. 7, 2008

(86) PCT No.: PCT/JP2008/070724

§ 371 (c)(1),
(2), (4) Date: May 19, 2010

(87) PCT Pub. No.: WO2009/066613

PCT Pub. Date: May 28, 2009

(65) Prior Publication Data

US 2010/0252218 A1 Oct. 7, 2010

(30) Foreign Application Priority Data

Nov. 20, 2007 (JP) ..... 2007-300304

(51) Int. Cl.
*D21G 9/00* (2006.01)

(52) U.S. Cl. ..... 162/289

(58) Field of Classification Search ..... 162/289, 162/358, 306, 358.4, 801; 428/212, 234; 442/118

See application file for complete search history.

(56) References Cited

U.S. PATENT DOCUMENTS

| | | | | |
|---|---|---|---|---|
| 4,500,588 | A | 2/1985 | Lundstrom | |
| 5,549,967 | A | 8/1996 | Gstrein et al. | |
| 6,207,276 | B1 | 3/2001 | Spindler et al. | |
| 7,931,780 | B2 * | 4/2011 | Inoue | 162/306 |
| 2004/0185729 | A1 | 9/2004 | Inoue | |
| 2009/0014143 | A1 | 1/2009 | Kobayashi et al. | |
| 2009/0020252 | A1 | 1/2009 | Onikubo et al. | |
| 2009/0095433 | A1 | 4/2009 | Inoue | |
| 2009/0120603 | A1 | 5/2009 | Fujita et al. | |
| 2010/0043998 | A1 | 2/2010 | Ohuchi | |
| 2010/0059135 | A1 | 3/2010 | Ogiwara | |
| 2010/0163202 | A1 | 7/2010 | Onikubo et al. | |
| 2010/0319869 | A1 | 12/2010 | Inoue et al. | |

FOREIGN PATENT DOCUMENTS

| | | | |
|---|---|---|---|
| DE | 198 03 493 | C1 | 4/1999 |
| JP | 3104995 | A | 5/1991 |
| JP | 2007327155 | A | 12/2007 |

* cited by examiner

*Primary Examiner* — Mark Halpern
(74) *Attorney, Agent, or Firm* — Howson & Howson LLP

(57) ABSTRACT

The papermaking felt 10 of the present invention comprises a base body 20, a wet paper web side batt fiber layer 31, and a backside batt fiber layer 32, in which the wet paper web side batt fiber layer 31 is contained in high molecular weight elastic material and the backside batt fiber layer 32 includes a melting fiber.

3 Claims, 4 Drawing Sheets

FELT FOR PAPERMAKING

CROSS-REFERENCE TO RELATED APPLICATIONS

This application is a national stage of International Patent Application No. PCT/JP2008/070724, filed Nov. 7, 2008, which claims priority of Japanese Patent Application No. 2007-300304, filed Nov. 20, 2007.

TECHNICAL FIELD

The present invention relates to a papermaking felt used in a papermaking machine (hereinafter also referred to as a "felt").

BACKGROUND ART

A papermaking process in a papermaking machine consists of three main parts, namely, forming, press, and drying sections, through which a wet paper web is dewatered continually.

Each section employs papermaking equipments with a dewatering function.

Conventionally, a papermaking felt is employed in the press section, where a felt with a wet paper web thereon is pressurized by a pressing system so that water contained in the wet paper web moves into the felt.

The press portion of the press section is generally composed of a pair of press rolls or a press roll coupled with a shoe shaped to conform to the peripheral surface of the press roll.

Referring to FIG. 1, the structure of the felt is to be described. FIG. 1 illustrates a cross-sectional view of the felt in the cross (CMD) direction. A papermaking felt 10 comprises a base body 20 having batt fiber layers on two sides thereof, a wet paper web side batt fiber layer 31 and a backside batt fiber layer 32, which are implanted by, for example, needle punching.

The base body 20 is usually a woven fabric made of a warp yarn 21 and a weft yarn 22.

Basic functions of a felt are to dewater a wet paper web (dewatering capability), to improve smoothness of a wet paper web (smoothness), and to transfer a wet paper web (capability to transfer a wet paper web), among which the dewatering function is deemed especially important.

When a wet paper web passes between a pair of press rolls, water moves out from the wet paper web into the felt by pressurization. Water within the felt is either discharged from the underside of the felt or discharged outside of the felt after vacuumed up in a suction box of a papermaking machine. Accordingly, there has been a demand for a felt having a function to be compressed under pressure and rebound when depressurized.

In the field of papermaking techniques, operational speed of papermaking machines and the pressure of a roll or a shoe press in the press section have been increased with an aim to improve productivity. These changes have resulted in a problem that the felt is flattened under high pressure, impairing its water permeability and capability to rebound after compression, which leads to sharp degradation of dewatering capability.

One of the solutions for this problem is to impregnate a fiber layer of a felt with high molecular weight elastic material.

A well-known example is a felt in which fibers are impregnated with emulsion resin and inventiveness lies in a wet paper web side part (U.S. Pat. No. 4,500,588). More specifically, the batt fibers on the surface of the base layer is impregnated with emulsion resin, and a barrier layer is formed on the surface of the wet paper web side of this batt fiber layer by calendaring to make the surface smooth like chamy leather.

However, even the above-mentioned felt, in which batt fibers disposed on the surface of the base layer are impregnated with resin, has left problems unresolved in that it cannot be easily set in a papermaking machine and is not effective enough to prevent rewetting phenomenon in the pressure portion of the press section, when used in recent high-speed papermaking machines, especially in a press section of a closed-draw-type papermaking machine.

Papermaking felts experience rewetting phenomenon in which a wet paper web absorbs water contained in the felt due to negative pressure within the wet paper web produced when the felt is released from pressure at the exit of the press portion of the press section. In a conventional felt (see specification of U.S. Pat. No. 4,500,588), rewetting phenomenon is restrained to a certain extent due to a dense batt fiber layer having resin therein. However, when the whole felt (all the base body and the batt layer) is impregnated with resin, the felt becomes so hardened that the felt cannot be easily set in a papermaking machine. Conventionally, therefore, some felts have resin only in a wet paper web side batt fiber layer. Such a felt, however, becomes incapable of preventing rewetting when used in a press section of a closed draw papermaking machine, because the batt layer contains much water even after pressurization due to low density of the back side batt fiber layer.

DISCLOSURE OF INVENTION

Problems to be Solved by the Invention

Thus, it is an object of this invention to provide a papermaking felt which is capable of maintaining functions of a felt over a long period of time since beginning of use, i.e., a capability to rebound after compression, dewatering capability, and wet paper smoothing function, and which has flexibility so as to be easily set in a closed draw papermaking machine and is capable of preventing rewetting in the press portion thereof.

The present invention solved the above problems with a papermaking felt which comprises a base body, a wet paper web side batt fiber layer, and a backside batt fiber layer, said wet paper web side batt fiber layer being contained in high molecular weight elastic material, and said backside batt fiber layer including a melting fiber.

Further, the papermaking felt of the present invention is characterized in that said high molecular weight elastic material is emulsion resin including at least one of urethane series emulsion, vinyl acetate series emulsion, styrene-butadiene series emulsion, and acrylic emulsion.

Furthermore, the papermaking felt of the present invention is characterized in that said melting fiber contains low-melting-point material with a melting point of 180 degrees C. or less.

The felt of this invention is capable of maintaining functions as a felt, such as a capability to rebound after compression, dewatering capability, and wet paper smoothing function, over a long period of time since setting in and beginning of use, and has flexibility so as to be easily set in a closed draw papermaking machine, and is capable of restraining rewetting in the press portion.

PREFERRED EMBODIMENTS OF THE INVENTION

Embodiments of the present invention are to be described hereafter, which should not be interpreted to limit the scope of this invention.

Figure 1:
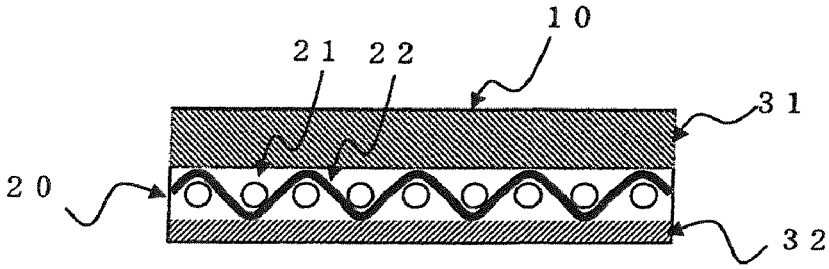
Fig. 1 (PRIOR ART)
FIG. 1 is a cross-sectional schematic view of a conventional papermaking felt.
Figure 2:
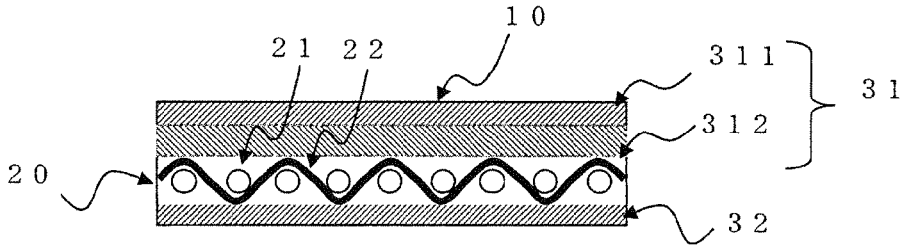
FIG. 2 is a cross-sectional schematic view of a papermaking felt of the present invention.

FIG. 2 is a (CMD) cross-sectional view of a felt. The papermaking felt 10 comprises a base body 20 and batt fibers 31, 32 layered thereon, which are intertwined together by needling.

The base body 20 is usually a fabric woven with a warp yarn 21 and a weft yarn 22 which are monofilaments and multifilaments of nylon, polyester, or olefin etc.

The fabric may be a single-layer fabric, or may have multiply-woven structure, such as a double or triple-layer fabric. Other examples include a base body made by bonding warp and weft yarns with adhesive or other bonding means, an unwoven fabric, a film, or molded plastics.

The batt fiber layers 31, 32 made of staple fibers may blend fibers having different diameter or material such as layers of webs of synthetic fibers like nylon fiber or natural fibers like wool.

The batt fiber layers comprises a wet paper web side batt fiber layer 31 and a backside batt fiber layer 32 disposed on the side of a press roll or a shoe press of a papermaking machine. To improve surface property, the wet paper web side batt fiber layer 31 may have fine fibers in a batt fiber layer 311 on the side closest to the wet paper web and have thicker fibers in a batt fiber layer 312 on the inner side. The wet paper web side batt fiber layer 31 is contained in high molecular weight elastic material. And the backside batt fiber layer 32 includes melting fibers.

Figure 3:
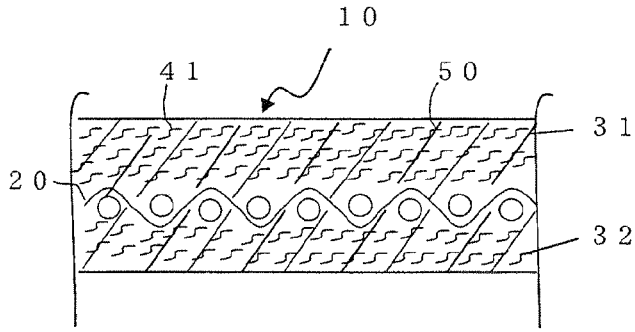
FIG. 3 is a cross-sectional schematic view of another papermaking felt of the present invention.

In the papermaking felt 10 of the present invention illustrated in FIG. 3, the wet paper web side batt fiber layer 31 made of staple fibers 41 is contained in the high molecular weight elastic material 50, integrally forming the batt fiber layer 31, and the backside batt fiber layer 32 includes melting fibers.

Since the wet paper web side batt fiber layer 31 is formed integrally by contained in the high molecular weight elastic material 50, even after repetitive compression of the felt by the press, pores within the wet paper web side batt fiber layer 31 survive compression due to pressure resistance of the high molecular weight elastic material 50. Thus, the felt maintains its water permeability and capability to rebound after compression. The felt, therefore, is capable of maintaining functions as a felt, such as reboundability, dewatering capability, and wet paper smoothing function, over a long period of time since the beginning of use.

Moreover, including melting fibers, the backside batt fiber layer 32 may constitute a dense and soft layer by thermal processing of the felt, which means the completed felt can be easily set in a machine and is capable of preventing rewetting of the wet paper web in the press portion. More specifically, when treated with heat, the melting fibers in the backside batt fiber layer 32 are at least partially melted and fused with each other to form a stereoscopic net-like structure. Such a net-like structure is dense in nature, and therefore the batt layer contains less water therein, which is effective to block rewetting of the felt. In addition, net-like structure of the batt fibers 32 is much softer than the batt fiber layer 31 contained in the high molecular weight elastic material 50.

The melting fiber may be selected from synthetic fibers made from or including low-melting-point material with a melting point of 180 degrees C. or less.

While the wet paper web side batt fiber layer 31 of the papermaking felt of the present invention provides the felt with a capability to rebound after compression, dewatering capability, or wet paper smoothing function, over a long period of time since the beginning of use, the backside batt fiber layer 32, forming a dense and soft batt fiber layer, provides flexibility and anti-rewetting property required for a felt used in closed draw papermaking machine. Thus, with a combination of the wet paper web side batt fiber layer 31 and the backside batt fiber layer 32 and their respective properties, the papermaking felt of this invention can be advantageously used especially in a high-speed closed draw papermaking machine.

If the wet paper web side batt fiber layer 31 is not contained in the high molecular weight elastic material 50, the felt becomes prone to deformation by repetitive compression, which would result in the loss of functions of a felt to dewater, smooth, and transfer a wet paper web.

On the other hand, even when the wet paper web side batt fiber layer 31 is contained in the high molecular weight elastic material 50, without melting fibers in the backside batt fiber layer 32, the felt would become incapable of preventing rewetting of a wet paper web in a press portion of a closed draw papermaking machine.

The high molecular weight elastic material in the present invention is emulsion resin including at least one of urethane series emulsion, vinyl acetate series emulsion, styrene-butadiene series emulsion, and acrylic emulsion, whereby the batt fibers are impregnated with a solid body after evaporation of water therein. For stabilization, emulsion resin preferably includes surface-activating agent, viscosity modifier.

Preferred impregnation level of the high molecular weight elastic material in the wet paper web side batt fiber layer 31 is in the range of 20 $g/m^2$ to 150 $g/m^2$. Below this level, the felt would not be able to maintain its reboundability, or functions to dewater and smooth a wet paper web; exceeding the above level, water permeability and dewatering capability of the felt would be impaired.

An example of the methods to integrally form the wet paper web side batt fiber layer 31 by impregnating it with the high molecular weight elastic material 50 is to first obtain a felt by implanting batt fibers to the base body by means of needle punching, followed by application of water-diluted emulsion resin and drying.

The melting fiber in the present invention includes low-melting-point material with a melting point of 180 degrees C. or less. In this invention, the backside batt fiber layer 32 may contain the melting fiber in the range of 10 $g/m^2$ to 200 $g/m^2$. With the content below 10 $g/m^2$, the backside batt fiber layer 32 would not be dense enough to maintain anti-rewetting function in a press portion as required for a felt used in a closed draw papermaking machine.

To the contrary, with the content above 200 g/m$^2$, the backside batt fiber layer 32 would become so dense that the felt would become so hardened that it cannot be easily set in a papermaking machine. In the present invention, density of the backside batt fiber layer 32 is preferably in the range of 0.25 g/cm$^3$ to 0.55 g/cm$^3$.

The melting fiber which contains low-melting-point material with a melting point of 180 degrees C. or less includes those which consist only of material with a melting point of 180 degrees C. or less and those which are partially composed of material with a melting point of 180 degrees C. or less. An especially preferable example of the latter is a core-in-sheath conjugate fiber which comprises a core member being a high-melting-point material with a melting point of 200 degrees C. or more and a sheath member being a low-melting-point material with a melting point of 180 degrees C. or less.

As already mentioned, the content of the melting fiber in the backside batt fiber layer 32 is preferably in the range of 10 g/m$^2$ to 200 g/m$^2$, where the "content of the melting fiber" means the content of the low-melting-point material with a melting point of 180 degrees C. or less. Therefore, it should be noted that the content equals the amount of the low-melting-point material contained, in the case of a melting fiber which is partially composed of the material with a melting point of 180 degrees C. or less like the above-mentioned core-in-sheath conjugate fiber.

Examples of the low-melting-point material with a melting point of 180 degrees C. or less includes polyolefin, such as polyethylene or polypropylene, polyester, and polyamide (nylon). Nylon with an especially low melting point includes binary copolymerized nylon such as nylon 6/12, nylon 6/612, nylon 66/6, nylon 66/12, nylon 66/612, and ternary copolymerized nylon such as nylon 6/66/12 and nylon 66/66/610.

In the present invention, the backside batt fiber layer 32 forms a dense and soft layer by thermal processing. More specifically, batt fiber layers are formed on the wet paper web side and the back side of a base body to make an endless felt, which is placed and driven around a pair of rollers, during which the melting fibers contained in the backside batt fiber layer 32 are subjected to heated air at a temperature above the melting point, or the felt is subjected to hot press immediately after the hot-air treatment. Thus, at least part of the melting point in the backside batt fiber layer 32 melts to form a dense and soft layer. Preferable temperature ranges of the hot air and hot press are 160-200 degrees C. and 140-180 degrees C. respectively.

EXAMPLES

Following tests were conducted to determine the effects of the papermaking felt of the present invention.

In order to test examples and comparative examples under the same condition, all the felts have common basic structure as follows:

Base body: 1/1 plain-weave fabric woven with nylon monofilament twist yarn, with a basis weight of 750 g/m$^2$ The wet paper web side batt fiber layer: 17dtex nylon 6 staple fiber, with a basis weight of 500 g/m$^2$ The backside batt fiber layer: a fiber layer of a blend of 17dtex staple fiber of the core-in-sheath conjugate fiber specified below and 17dtex staple fiber of nylon 6, with a total basis weight of 200 g/m$^2$. The content of the core-in-sheath conjugate fiber is specified in Table 1.

Core-in-sheath conjugate fiber: a synthetic fiber, the core member being nylon 6 and the sheath member being copolymerized nylon 6/12, the weight percent ratio of which is 1:1.

The wet paper web side batt fiber layer and the backside batt fiber layer were intertwined with the base body by needling to obtain a felt, and a predetermined amount of water-diluted urethane series emulsion ("SUPERFLEX", made by Dai-Ichi Kogyo Seiyaku Co., Ltd.), high molecular weight elastic material, was applied from the wet paper web side of the felt. The application quantity (content) of the high molecular weight elastic material is specified in Table 1. The high molecular weight elastic material was applied to both of the wet paper web side and the backside of the felt in one example (Comparative Example 4). All the felts were then dried at 105 degrees C., underwent hot press at 160 degrees C., 50 kg/cm$^2$ while subjected to hot air at 180 degrees C.; thus Examples 1-6 and Comparative Examples 1-4 were completed.

Properties of the completed felts are shown in Table 1. Density (g/cm$^3$) of the backside batt layer was obtained by dividing the basis weight of the backside batt layer (200 g/m$^2$) by the thickness thereof. Bending resistance represents values relative to 100 representing Comparative Example 1, based on the average of the result obtained by measuring the two sides of a sample piece of each completed felt 5 times in accordance with the bending resistance test A method (Gurley method) specified in Japan Industrial Standards JIS L-1096 (testing methods for woven fabrics).

TABLE 1

| | Content of core-sheath conjugate fibers in backside batt fiber layer; numbers in ( ) represents density thereof (g/cm$^3$) | Application quantity of high molecular weight elastic material | Bending resistance |
|---|---|---|---|
| Example 1 | 20 g/m$^2$ (0.25) | 50 g/m$^2$ | 250 |
| Example 2 | 50 g/m$^2$ (0.32) | 50 g/m$^2$ | 260 |
| Example 3 | 100 g/m$^2$ (0.40) | 50 g/m$^2$ | 280 |
| Example 4 | 200 g/m$^2$ (0.45) | 50 g/m$^2$ | 330 |
| Example 5 | 400 g/m$^2$ (0.55) | 50 g/m$^2$ | 430 |
| Example 6 | 100 g/m$^2$ (0.40) | 100 g/m$^2$ | 410 |
| Comparative Example 1 | None (0.22) | None | 100 |
| Comparative Example 2 | None (0.22) | 50 g/m$^2$ | 230 |
| Comparative Example 3 | 100 g/m$^2$ (0.40) | None | 150 |
| Comparative Example 4 | None; included 50 g/m$^2$ of urethane series emulsion | 100 g/m$^2$ | 500 |

Table 1 indicates that the examples of the felt are flexible and therefore easy to be set in a papermaking machine, because the backside batt fiber layer, although having high density, exhibits relatively low bending resistance.

Figure 4:
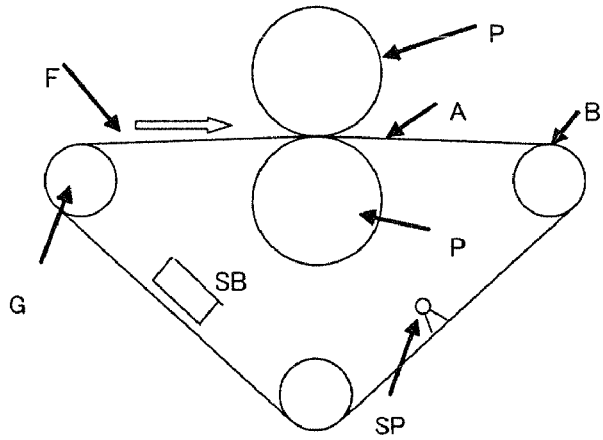
FIG. 4 is a schematic view of a testing machine for the present invention.

Completed Examples and Comparative Examples of the felt then underwent tests to evaluate their functions by means of a testing machine as illustrated in FIG. 4.

The testing machine in FIG. 4 comprises a pair of press rolls P (the lower press being a shoe press with a diameter of 1500 mm and the upper press being a steel roll), a guide roll G, a shower part SP, and a suction box SB, and repetitively presses a felt F placed therein, stretching and turning the felt around the rollers. The testing machine was operated for 240 hours with a pressure of 1000 kg/cm at the shoe press and felt driving speed of 1500 m/minute; freshwater was sprayed to the felt from the shower part at a rate of 0.1 liter/$m^2$, which was sucked into the suction box to keep the water content of the felt at 30% when it enters the press part.

Evaluation of Functions

Compression rate and rebound rate were obtained by the formula below. Both rates were measured immediately after the beginning of and after the end of the test. The compression rate and rebound rate were obtained by applying the value of thickness to the following formula, the thickness being measured after applying a pressure (30 kg/$cm^2$) to a felt following 1 hour of immersion in water.

Compression rate(%)=(thickness of felt when compressed/original thickness of felt without pressure)×100

Rebound rate(%)=(thickness of felt right after released from compression/thickness of felt when compressed)×100

Further, anti-rewetting effect of the felt was measured by placing sample pieces of a wet paper web with water content of 50% at the entry point to the press part of the testing machine, and collecting them at point A (close to the exit of the press part) and point B (on the guide roll distant from the exit of the press part).

When the gap of their water content is below 0.5%, the felt was evaluated to have a "good" anti-rewetting effect; those with the gap in the range of 0.5-0.9% and 1.0% or more were respectively evaluated to "fair" and "failure" in terms of anti-rewetting property.

FIG. 2 shows the results.

TABLE 2

| | Compression rate (%) | | Rebound rate (%) | | Rewetting prevention effect | | |
|---|---|---|---|---|---|---|---|
| | At onset | Upon termination | At onset | Upon termination | Water content at A | Water content at B | Evaluation based on water content gap of wet paper web |
| Example 1 | 50 | 40 | 50 | 40 | 47.5 | 48.0 | Fair |
| Example 2 | 50 | 40 | 50 | 40 | 47.4 | 47.9 | Fair |
| Example 3 | 50 | 45 | 50 | 45 | 47.5 | 47.6 | Good |
| Example 4 | 45 | 45 | 45 | 45 | 47.3 | 47.4 | Good |
| Example 5 | 45 | 45 | 45 | 45 | 47.3 | 47.4 | Good |
| Example 6 | 45 | 45 | 45 | 45 | 47.8 | 48.0 | Good |
| Comparative Example 1 | 60 | 30 | 60 | 30 | 49.0 | 50.1 | Failure |
| Comparative Example 2 | 50 | 35 | 55 | 35 | 48.3 | 49.3 | Failure |
| Comparative Example 3 | 55 | 35 | 55 | 35 | 48.3 | 48.7 | Fair |
| Comparative Example 4 | 45 | 45 | 45 | 45 | 47.5 | 48.5 | Failure |

Although the compression and rebound rates remain at low levels for Examples at the beginning of the test, the rates obtained right after the test are higher compared to Comparative Examples. Thus, it was confirmed that the examples is capable of maintaining reboundability and hence exhibit and maintain good dewatering capability. It was also confirmed that the wet paper web is less likely to be rewet by the felt while transferred thereon after pressurized by the press.

According to this invention, the felt can be easily set in a papermaking machine, because batt fibers in the felt include high molecular weight elastic material, integrally forming a wet paper web side batt fiber layer, while a backside batt fiber layer forms a dense and soft layer of melting fibers. Further, the felt is capable of maintaining reboundability even after repetitive compression by a press due to pressure resistance of the high molecular weight elastic material.

Furthermore, as the content of melting fibers in the backside batt fiber layer is increased, the felt becomes more effective in rewetting prevention.

Industrial Applicability

According to the present invention, the papermaking felt is capable of maintaining functions as a felt, such as a capability to rebound after compression, dewatering capability, or wet paper smoothing function, over a long period of time since setting in and the beginning of use, and has flexibility so as to be easily set in a closed draw papermaking machine and effectively prevents rewetting in the press portion.

What is claimed is:

1. A papermaking felt composed of a base body, a wet paper web side batt fiber layer, a backside batt fiber layer, a high molecular weight elastic material, and core-in-sheath conjugate fibers;

wherein said high molecular weight elastic material is on the wet paper web side of the base body and said wet paper web side batt fiber layer is contained in said high molecular weight elastic material; and wherein said core-in-sheath conjugate fibers are contained in said backside batt fiber layer and the sheaths of said core-in-sheath conjugate fibers are composed of a low-melting-point material having a melting point of 180 degrees C. or less.

2. A papermaking felt as claimed in claim 1, wherein said high molecular weight elastic material is emulsion resin comprising at least one of urethane series emulsion, vinyl acetate series emulsion, styrene-butadiene series emulsion, and acrylic emulsion.

3. A papermaking felt as claimed in claim 1, wherein the core of said core-in-sheath conjugate fiber has a melting point of 200 degrees or more.

* * * * *